US008882376B2

(12) United States Patent
Yoshioka

(10) Patent No.: US 8,882,376 B2
(45) Date of Patent: Nov. 11, 2014

(54) PRINTER, CUT PAPER DISCHARGE MECHANISM USED FOR PRINTER, AND PAPER JAM PREVENTION METHOD

(75) Inventor: Yukio Yoshioka, Kawasaki (JP)

(73) Assignee: NEC Infrontia Corporation, Kanagawa (JP)

( * ) Notice: Subject to any disclaimer, the term of this patent is extended or adjusted under 35 U.S.C. 154(b) by 762 days.

(21) Appl. No.: 11/519,765

(22) Filed: Sep. 13, 2006

(65) Prior Publication Data

US 2007/0065217 A1 Mar. 22, 2007

(30) Foreign Application Priority Data

Sep. 14, 2005 (JP) ..... 2005-266320

(51) Int. Cl.

| | |
|---|---|
| ***B41J 11/00*** | (2006.01) |
| ***B41J 11/70*** | (2006.01) |
| ***B41J 15/04*** | (2006.01) |
| ***B65H 35/06*** | (2006.01) |

(52) U.S. Cl.

CPC ..... *B41J 11/70* (2013.01); *B41J 11/006* (2013.01); *B65H 2601/10* (2013.01); *B65H 35/06* (2013.01); *B41J 11/0045* (2013.01)

USPC ..... 400/621; 400/605; 400/642

(58) Field of Classification Search

USPC ..... 400/621, 605, 120.16, 617, 619, 642

See application file for complete search history.

(56) References Cited

U.S. PATENT DOCUMENTS

| | | | | |
|---|---|---|---|---|
| 3,877,560 | A * | 4/1975 | Shimodaira et al. | 400/619 |
| 5,438,391 | A * | 8/1995 | Maekawa et al. | 399/125 |
| 5,917,533 | A * | 6/1999 | Suzuki et al. | 347/214 |
| 6,109,805 | A * | 8/2000 | Ono et al. | 400/618 |
| 6,652,173 | B1 * | 11/2003 | Martini et al. | 400/621 |
| 6,902,161 | B2 * | 6/2005 | Gordon et al. | 271/161 |
| 7,002,612 | B2 * | 2/2006 | Imai et al. | 347/215 |
| 7,234,381 | B2 * | 6/2007 | Granger | 83/649 |
| 2004/0095593 | A1 * | 5/2004 | Chung et al. | 358/1.12 |
| 2005/0232678 | A1 * | 10/2005 | Mochizuki et al. | 400/621 |
| 2006/0008312 | A1 * | 1/2006 | Sago et al. | 400/642 |
| 2007/0079676 | A1 * | 4/2007 | Friesen et al. | 83/37 |

FOREIGN PATENT DOCUMENTS

| | | | | |
|---|---|---|---|---|
| EP | 0230313 | * | 1/1987 | B65H 5/06 |
| JP | 59-162551 U | | 10/1984 | |
| JP | 62-128055 U | | 8/1987 | |
| JP | 63-242577 | * | 10/1988 | B41J 13/10 |
| JP | 03158264 | * | 7/1991 | 400/621 |
| JP | 4-308151 A | | 10/1992 | |
| JP | 06031692 | * | 2/1994 | 83/436.7 |
| JP | 06118818 | * | 4/1994 | G03G 15/20 |

(Continued)

*Primary Examiner* — Judy Nguyen

*Assistant Examiner* — Marissa Ferguson Samreth

(74) *Attorney, Agent, or Firm* — Sughrue Mion, PLLC

(57) ABSTRACT

A plurality of ribs are provided on a cut paper discharge guide and an upper cover which define a discharge port for discharging a cut paper. The ribs hold a cut paper in width direction. Even if a cut paper having a high degree of curl is supplied when a roll diameter of a roll paper is reduced, it is possible to prevent a paper jam such as falling or clogging of the cut paper. It is desirable that the ribs provided on the cut paper discharge guide and the upper cover are disposed in an alternate pattern along the width direction of the discharge port. This arrangement is particularly effective in a printer having an inclined paper passage.

10 Claims, 6 Drawing Sheets

(56) References Cited

FOREIGN PATENT DOCUMENTS

| | | | | | |
|---|---|---|---|---|---|
| JP | 6-255869 | A | | 9/1994 | |
| JP | 7-10351 | A | | 1/1995 | |
| JP | 9-128655 | A | | 5/1997 | |
| JP | 2000-95417 | A | | 4/2000 | |
| JP | 2001-246593 | A | | 9/2001 | |
| JP | 2001-293684 | A | | 10/2001 | |
| JP | 2002-144657 | A | | 5/2002 | |
| JP | 2011-037064 | | * | 2/2011 | ..... B41J 11/70 |

* cited by examiner

PRINTER, CUT PAPER DISCHARGE MECHANISM USED FOR PRINTER, AND PAPER JAM PREVENTION METHOD

This application claims priority to prior application JP2005-266320, the disclosure of which is incorporated herein by reference.

BACKGROUND OF THE INVENTION

1. Field of the Invention

The present invention relates to a printer having functions of recording on an integrated roll paper, then cutting the roll paper by a cutter, and discharging the cut paper to an exterior of the printer. The present invention also relates to a cut paper discharge mechanism used for such a printer, and to a paper jam prevention method used in such printer.

2. Description of the Related Art

Generally, this type of printer has a structure in which a thermal head, a cutter unit, and a discharge port are arranged in a vertical direction. With such an arrangement, a paper is discharged through a paper passage extending in a vertical direction from the cutter unit, which is disposed at a lower portion of the printer, toward the discharge port, which is disposed at an upper portion of the printer. The roll paper is integrated into the printer. The thermal head or the like prints on the roll paper. The printed roll paper is cut by the cutter unit. The cut paper is discharged through the discharge port to above the discharge mechanism. The printer having such an arrangement is widely used for POS terminal devices for issuing receipts and automatic dispensers for issuing coupons or tickets.

Recently, many printers have employed an arrangement for discharging a printed roll paper in a fully cut state, called a full-cut paper. A paper jam is problematically caused in a printer in which full-cut papers are discharged to above a discharge mechanism.

Cutter units capable of preventing a paper jam have been proposed in Japanese laid-open patent publications Nos. 2001-246593 (Patent Document 1) and 2001-293684 (Patent Document 2).

The cutter unit disclosed by Patent Document 1 includes a stationary blade member having a stationary plate blade and a movable blade member having a movable plate blade. When the movable blade is reciprocated with respect to a paper passage defined between the stationary blade and the movable blade, a roll paper is cut by the blades. The full-cut paper is discharged through a discharge port. The cutter unit disclosed by Patent Document 1 introduces an edge of a full-cut paper cut by the movable blade into a groove portion provided in the stationary blade with use of the movable blade so as to prevent the full-cut paper from falling into a paper passage in the printer.

The cutter unit disclosed by Patent Document 2 controls a position of a movable blade so as to dispose the movable blade at a standby position at which the movable blade covers a paper inlet, which forms a paper passage, after cutting a roll paper. Specifically, when supply of the roll paper is started, the movable blade is moved from the standby position so as to open the paper inlet. When the roll paper is supplied by a predetermined length, the movable blade is moved to the standby position. Then, the roll paper is cut, and the supply of the roll paper is stopped.

Thus, the cutter units disclosed by Patent Documents 1 and 2 prevent falling of the full-cut paper or re-cutting of the full-cut paper by supporting the edge of the full-cut paper on the stationary blade or by controlling a position of the movable blade in the cutter unit. However, Patent Documents 1 and 2 fail to disclose an improvement of an arrangement in portions other than the cutter unit to prevent falling of a full-cut paper or the like.

Meanwhile, a paper passage extending from a cutter unit to a discharge port may be inclined in order to prevent falling of a full-cut paper. According to experiments conducted by the inventors, when a paper passage extending from a cutter unit to a discharge port was inclined, it was necessary to consider that a degree of curl of a full-cut paper varied according to a variation of a radius of curvature of the roll paper (a roll diameter of the roll paper). Specifically, the roll paper has a large radius of curvature (i.e., a small curvature) near its beginning. As a result, full-cut papers have a low degree of curl. The roll paper has a small radius of curvature (i.e., a large curvature) near its dead end so as to produce a strong tendency to curl. Accordingly, a degree of curl of full-cut papers becomes high.

More specifically, if a full-cut paper having a low degree of curl is supplied from a cutter unit through an inclined paper passage into a discharge port, then the full-cut paper falls onto a portion of the cutter unit through the paper passage. Accordingly, the full-cut paper is prevented from falling into a paper passage in the printer as with the cutter units disclosed by Patent Documents 1 and 2.

However, when the paper passage was inclined, a lower end of the full-cut paper was not supported by a portion of the cutter unit if the full-cut paper has a high degree of curl. That is, the lower end of the full-cut paper is separated from the portion of the cutter unit. It was found that the full-cut paper fell off from the inclined paper passage into a paper passage in the printer.

SUMMARY OF THE INVENTION

It is an object of the present invention to provide a printer having a function of preventing troubles such as a paper jam in a discharge port even if a full-cut paper has a high degree of curl.

A printer according a first aspect of the present invention comprises a cutter unit operable to cut a roll paper for printing and a cut paper discharge mechanism operable to discharge a cut paper cut by the cutter unit through a discharge port. The cut paper discharge mechanism has a holding member for holding the cut paper according to a degree of curl of the cut paper.

A cut paper discharge mechanism according to a second aspect of the present invention has a discharge port defined in a printer for cutting a roll paper and discharging the cut paper. The cut paper discharge mechanism comprises a holding member for holding the cut paper.

In the first and second aspects, it is desirable that the holding member includes a plurality of ribs provided along the discharge port in a direction crossing a discharge direction in which the cut paper is discharged.

In the first and second aspects, it is desirable that the holding member includes a cut paper discharge guide and a cover member which define the discharge port, and that the plurality of ribs are disposed along the direction crossing the discharge direction at predetermined intervals.

In the first and second aspects, it is desirable that the plurality of ribs are provided in an alternate pattern along the discharge port on the cut paper discharge guide and the cover member.

In the first and second aspects, it is desirable that the plurality of ribs are disposed symmetrically with respect to a center of the direction crossing the discharge direction.

In the first and second aspects, it may further comprises a cutter cover to which the cut paper discharge guide is attached via a coil spring so as to form a predetermined space between the cut paper discharge guide and the cover member.

A paper jam prevention method according to a third aspect of the present invention is used in a printer having a cutter unit operable to cut a roll paper for printing, and a cut paper discharge mechanism operable to discharge a cut paper cut by the cutter unit through a discharge port to an upper portion of the cut paper discharge mechanism. The paper jam prevention method comprises discharging the cut paper in a state such that the cut paper is held by the cutter unit when the cut paper has a low degree of curl; while discharging the cut paper in a state such that the cut paper is held by a plurality of ribs provided on the cut paper discharge mechanism along the discharge port when the cut paper has a high degree of curl.

According to the present invention, there is provided a printer which can remove the necessity for taking out each of printed cut papers with hands, automatically discharge each cut paper, and store a certain number of cut papers in a discharge port. Further, there is provided a printer, a cut paper discharge mechanism, and a paper jam prevention method which do not cause troubles such as a paper jam even if a cut paper has a high degree of curl because of a tendency of curl in a roll paper.

The above and other objects, features, and advantages of the present invention will be apparent from the following description when taken in conjunction with the accompanying drawings which illustrate preferred embodiments of the present invention by way of example.

DETAILED DESCRIPTION OF THE PREFERRED EMBODIMENTS

Figure 1:
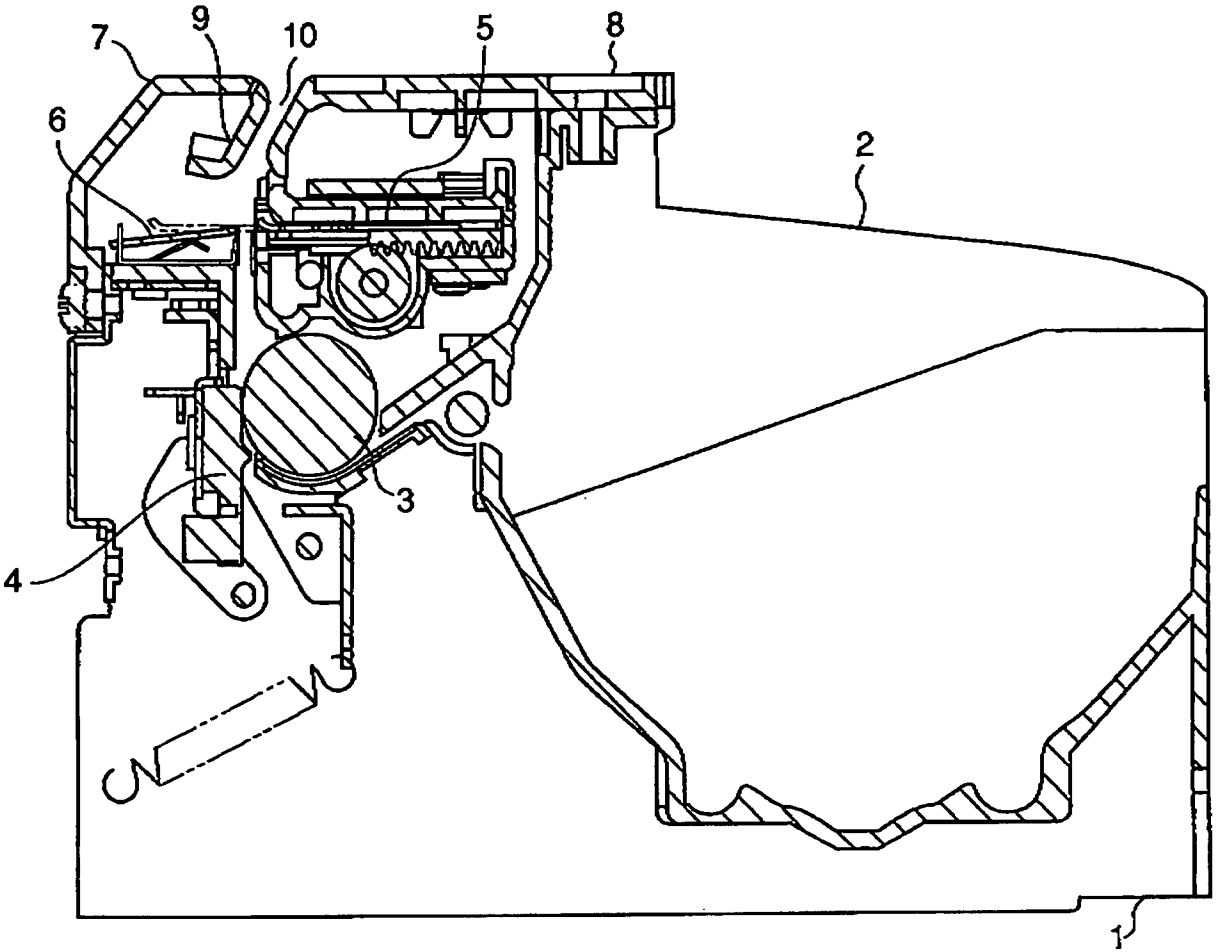
FIG. 1 is a cross-sectional view partially showing a printer according to the present invention.

FIG. 1 partially shows a cross-section of a printer according to an embodiment of the present invention. The illustrated printer has a lower frame 1, an upper frame 2, a platen roller 3 attached to the upper frame 2, and a thermal head 4 attached to the lower frame 1. The upper frame 2 is configured to be opened and closed with respect to the lower frame 1. A roller (not shown) for continuously supplying a paper for printing is mounted on the lower frame 1. A roll paper is introduced from the roller through a paper passage into a space between the platen roller 3 and the thermal head 4. The thermal head 4 prints on the roll paper.

Further, the roll paper is supplied in a vertical direction from the space between the platen roller 3 and the thermal head 4 to a cutter unit. The illustrated cutter unit has a movable blade unit 5 attached to the upper frame 2 and a stationary blade unit 6 attached to the lower frame 1. A paper passage is defined between the platen roller 3 and the thermal head 4 and between the movable blade unit 5 and the stationary blade unit 6 so as to extend in the vertical direction. The movable blade unit 6 is movable to a position above the stationary blade unit 6 across the paper passage. When the movable blade unit 5 crosses the paper passage, it cuts the printed roll paper. Then, the movable blade unit 5 returns to an original position. The movable blade unit 5 and the stationary blade unit 6 can be actuated by known mechanisms, which are not described herein.

The roll paper is fully cut by the illustrated cutter unit. The full-cut paper is discharged to a cut paper discharge mechanism provided on an upper side of FIG. 1. The illustrated cut paper discharge mechanism includes an upper cover (cover member) 8 provided on an upper portion of the upper frame 2, a cutter cover 7 provided on an upper portion of the lower frame 1, and a cut paper discharge guide 9. As shown in FIG. 1, a discharge port 10 is defined between the upper cover 8 and the cut paper discharge guide 9. The discharge port 10 is inclined at a predetermined angle with respect to the paper passage extending in the vertical direction from the space between the platen roller 3 and the thermal head 4 to the cutter unit. The discharge port 10 is inclined in an upward direction toward the movable blade unit 5. The inclination angle is set such that a lower end of a full-cut paper introduced to the discharge port 10 is placed on the stationary blade unit 6. As a result, the full-cut paper is discharged from the discharge port 10 upwardly in an oblique direction. The cut paper discharge mechanism according to the present invention includes holding members for holding a full-cut paper on a portion of the discharge port 10, which will be described later.

Figure 2:
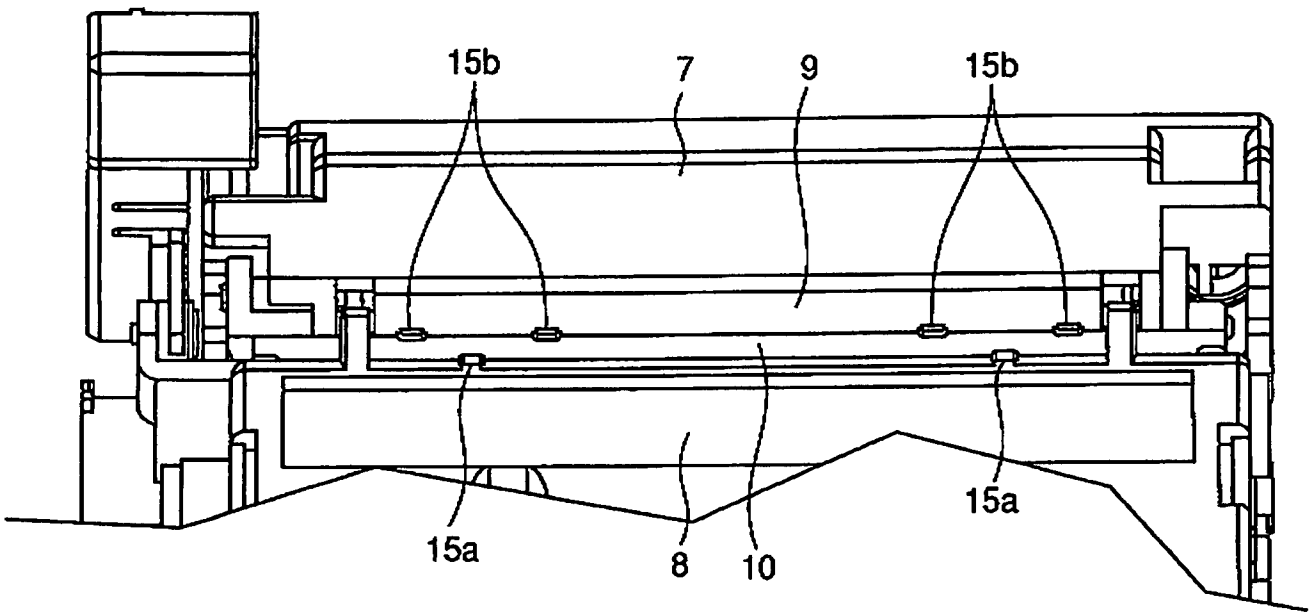
FIG. 2 is a front view explanatory of a cut paper discharge mechanism according to an embodiment of the present invention.

The cut paper discharge mechanism according to the embodiment of the present invention will be described below with reference to FIG. 2 together with FIG. 1. As shown in a front view of FIG. 2, the cut paper discharge mechanism includes the upper cover 8 and the cut paper discharge guide 9 attached to the cutter cover 7. The discharge port 10 is defined between the upper cover 8 and the cut paper discharge guide 9. In the illustrated example, a plurality of projections, or ribs, are provided as holding members along the discharge port 10, which extends in a transverse direction of FIG. 2. Specifically, a plurality of ribs are disposed at predetermined intervals along a direction crossing a discharge direction in which the full-cut paper is discharged from the discharge port 10, i.e., along a width direction of the full-cut paper. The plural ribs include two ribs 15*a* provided on the upper cover 8 and four ribs 15*b* provided on the cut paper discharge guide 9. The ribs 15*a* and the ribs 15*b* are disposed in an alternate pattern along the direction crossing the discharge direction in which the full-cut paper is discharged. Further, the ribs 15*a* are arranged symmetrically with respect to the center of the width direction of the full-cut paper. Similarly, the ribs 15*b* are arranged symmetrically with respect to the center of the width direction of the full-cut paper.

Since a plurality of ribs 15*a* and 15*b* are arranged in an alternate pattern along the discharge port 10, the full-cut paper can be held in the width direction. Thus, it is possible to hold a full-cut paper so that the full-cut paper does not fall off and to prevent a paper jam of full-cut papers curled in the discharge direction.

Figure 3:
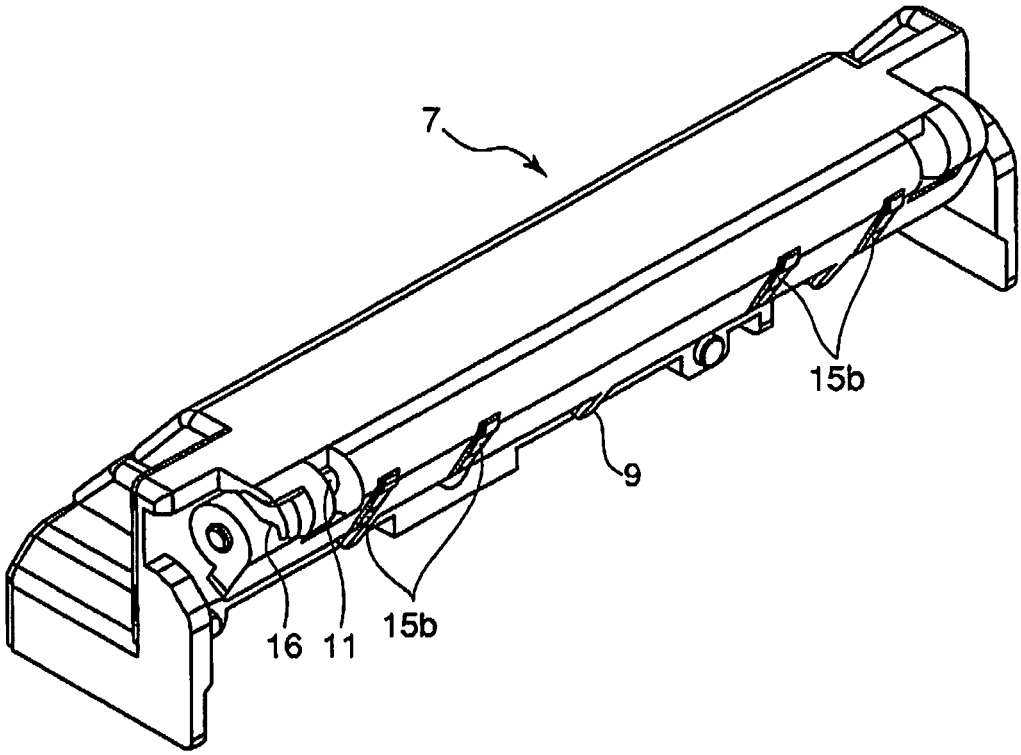
FIG. 3 is a perspective view explanatory of a cut paper discharge guide in the cut paper discharge mechanism shown in FIG. 2.

The cut paper discharge guide 9 shown in FIGS. 1 and 2 will be described in detail with reference to FIG. 3. As shown in FIG. 3, the cut paper discharge guide 9 is attached to the cutter cover 7 so as to be pivotable about a shaft 11. The four ribs 15*b* are provided on the cut paper discharge guide 9 near the discharge port at predetermined intervals. Further, a coil spring 16 is provided on one end of the cut paper discharge guide 9 so as to surround the shaft 11. The coil spring 16 has a first end fixed to the cutter cover 7 and a second end fixed to the cut paper discharge guide 9. With this arrangement, a torque is applied to the cut paper discharge guide 9. In a usual state, the cut paper discharge guide 9 is engaged with a stopper (not shown) and is thus prevented from being pivoted about the shaft 11. Accordingly, a predetermined space is formed between the cut paper discharge guide 9 and the upper cover 8. When a plurality of full-cut papers are brought into contact with the cut paper discharge guide 9, the cut paper discharge guide 9 is pivoted against the torque of the coil spring 16 so as to widen the aforementioned space. Thus, a plurality of full-cut papers can be stored in the discharge port 10.

Figure 4:
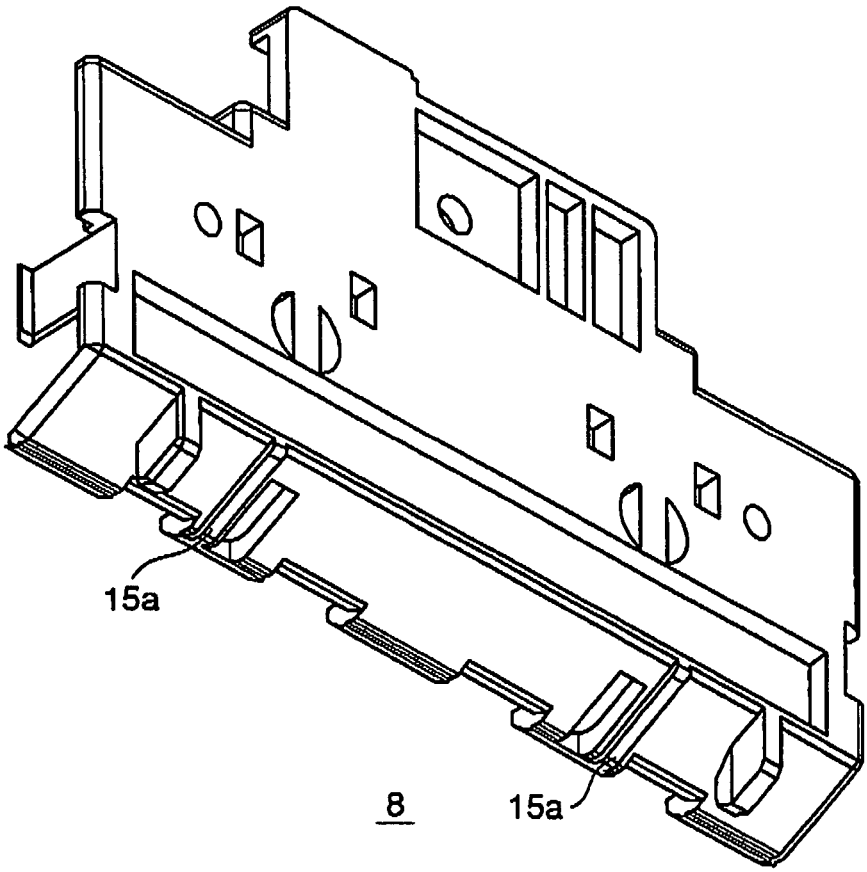
FIG. 4 is a perspective view explanatory of an upper cover in the cut paper discharge mechanism shown in FIG. 2.

The upper cover 8 according to the present invention will be described with reference to FIG. 4. As shown in FIG. 4, the two ribs 15*a* are provided along the discharge port on the upper cover 8 near the discharge port.

Referring back to FIG. 2, the cut paper discharge guide 9 and the upper cover 8 shown in FIGS. 3 and 4 are configured so that a space formed between the cut paper discharge guide 9 and the upper cover 8 allows several full-cut papers to pass therethrough. As described above, since the ribs 15*a*and 15*b* are disposed in an alternate pattern, a plurality of full-cut papers can be stored in a portion of the discharge port 10. This is effective in printers for POS terminal devices used in drugstores and the like in a case where no receipt is required to be handed to a customer. Intervals between the ribs 15*a* and the ribs 15*b*, which are disposed in an alternate pattern, may be set to be zero. Alternatively, the ribs 15*a* and the ribs 15*b* may overlap each other.

The printer according to the present invention prevents a paper jam including clogging full-cut papers or stagnating full-cut papers in the discharge port 10 or the like even if the roll diameter of a roll paper, which is continuously supplied through the cutter unit to the discharge port 10, is varied. This effect is achieved for the following reasons.

Figure 5A:
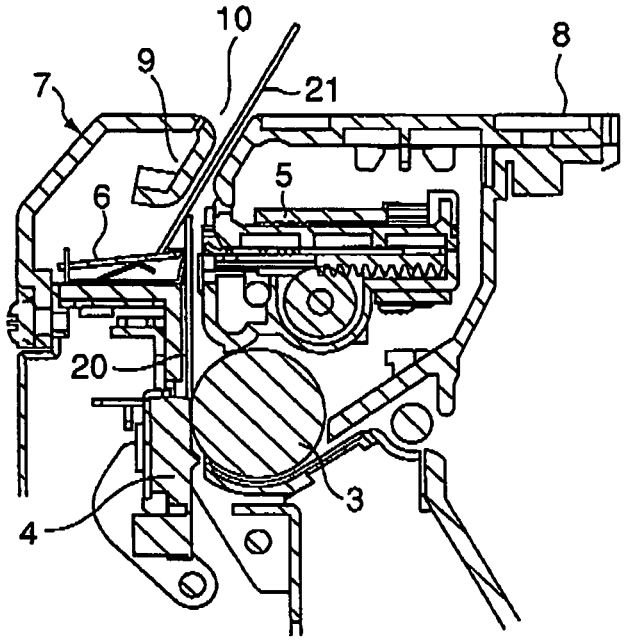
FIGS. 5A and 5B are cross-sectional views explanatory of operation of the cut paper discharge mechanism in a case where a roll paper has a large diameter.

With regard to a case where the roll paper has a relatively large roll diameter, operation of the printer according to the present invention will be described with reference to FIGS. 5A and 5B. When a roll paper has a large roll diameter, the roll paper 20 has a weak tendency to curl. Accordingly, the roll paper 20 has a large radius of curvature. As a result, as shown in FIG. 5A, the roll paper 20 to be supplied to the cutter unit has a low degree of curl. In this case, the roll paper 20 is supplied through the paper passage, which extends between the thermal head 4 and the platen roller 3, to the cutter unit substantially in the vertical direction. Then, the movable blade unit 5 crosses the paper passage to cut the roll paper 20 and returns to the original position. FIG. 5A shows a state in which a full-cut paper 21 cut by the cutter unit is discharged to the discharge port 10 while a top end of a subsequent roll paper 20 to be cut is supplied between the movable blade unit 5 and the stationary blade unit 6.

A lower end of the full-cut paper 21 cut by the cutter unit is brought into contact with an upper surface of the stationary blade unit 6. As a result, the full-cut paper 21 is held at the inclination angle of the discharge port 10, i.e., held in an inclined state. In this case, the full-cut paper 21 may be held by the cut paper discharge guide 9 and the ribs 15*a* of the upper cover 8, which are disposed along the discharge port 10.

Figure 5B:
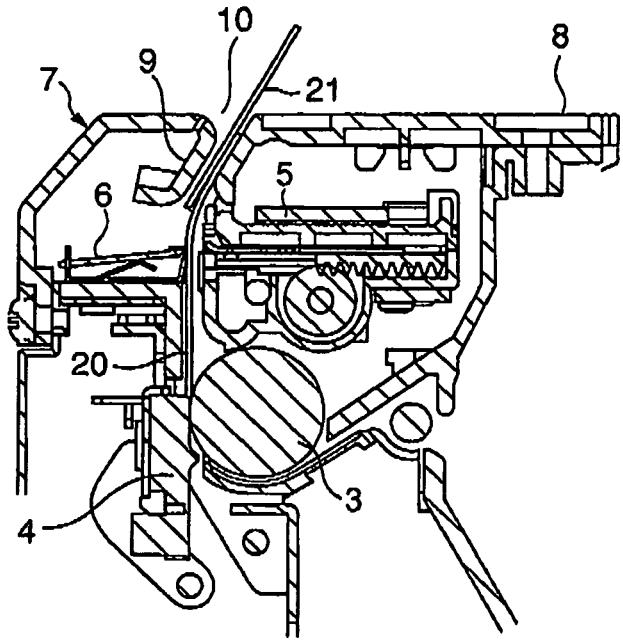

In the state shown in FIG. 5A, when the subsequent roll paper 20 is supplied to the cutter unit, as shown in FIG. 5B, the subsequent roll paper 20 slips under a lower surface of the full-cut paper 21, which is held in the inclined state. The slipping roll paper 20 serves to separate the full-cut paper 21 from the stationary blade unit 6 and to discharge the full-cut paper 21 from the discharge port 10. As shown in FIG. 5B, even if the full-cut paper 21 is separated from the stationary blade unit 6, frictional forces are produced between the full-cut paper 21 and the subsequent roll paper 20 by continuous supply of the roll paper 20. The full-cut paper 21 is discharged to the exterior of the printer from the discharge port 10 by the frictional forces. Thus, the full-cut paper 21 does not fall into a paper passage in the printer.

Figure 6A:
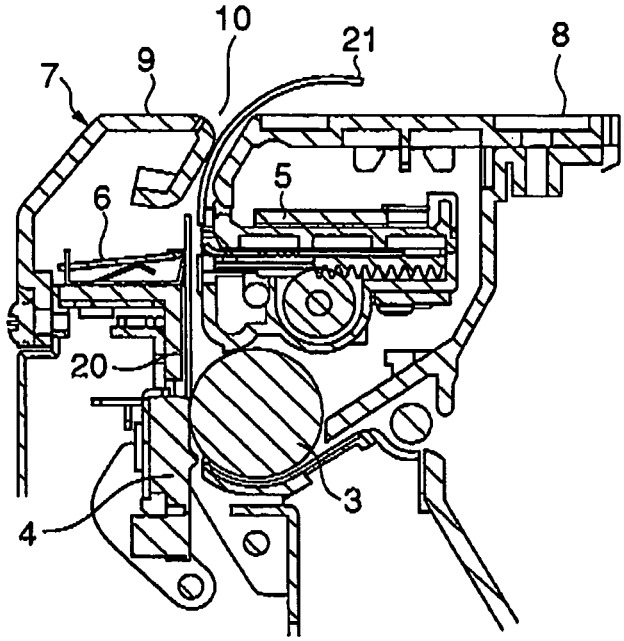
FIGS. 6A and 6B are cross-sectional views explanatory of operation of the cut paper discharge mechanism in a case where a roll paper has a small diameter.
Figure 6B:
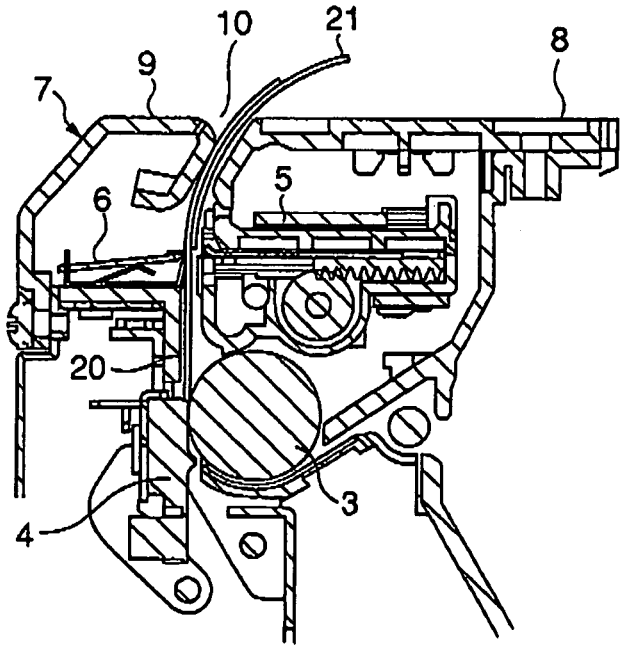

With regard to a case where the roll paper has a small roll diameter, operation of the printer according to the present invention will be described with reference to FIGS. 6A and 6B. When a roll paper has a small roll diameter, the roll paper 20 has a strong tendency to curl. Accordingly, as shown in FIG. 6A, a full-cut paper 21 cut by the cutter unit is discharged from the cutter unit to the discharge port 10 in a curly state (i.e., in a state such that the full-cut paper 21 has a high degree of curl). Unlike the case shown in FIG. 5A, the curled full-cut paper 21 is not held by the stationary blade unit 6, but by the ribs 15*a* and 15*b* provided on the upper cover 8 and the cut paper discharge guide 9 along the discharge port 10. Since the ribs 15*a* and 15*b* are disposed alternately in the width direction as shown in FIG. 2, both faces of the full-cut paper 21 are held by the ribs 15*a* and 15*b*. Accordingly, even though a lower end of the full-cut paper 21 is not supported by the stationary blade unit 6, the full-cut paper 21 does not fall into the paper passage in the printer. Thus, even if a curled full-cut paper 21 is supplied to the illustrated cut paper discharge mechanism, the cut paper discharge mechanism can hold the full-cut paper 21 without causing the falling of the full-cut paper 21.

When a subsequent roll paper 20 is supplied in a state in which the full-cut paper 21 is held by the ribs 15*a* and 15*b*, the subsequent roll paper 20 is introduced between the curled full-cut paper 21 and the cut paper discharge guide 9. Specifically, in a state in which the lower end of the full-cut paper 21 is separated from the stationary blade unit 6, the subsequent roll paper 20 is inserted between the full-cut paper 21 and the cut paper discharge guide 9. When the illustrated roll paper 20 is fully cut, the two full-cut papers are held in the discharge port 10 unless the first full-cut paper 21 is removed. Thus, a plurality of full-cut papers 21 are sequentially stored and held in the discharge port 10 by the ribs 15*a* and 15*b*. In the illustrated example, the printer is capable of storing about 10 full-cut papers 21 in the discharge port 10.

As more full-cut papers 21 are stored in the discharge port 10, the coil spring 16 of the cut paper discharge guide 9 shown in FIG. 3 is twisted so as to widen the space between the upper cover 8 and the cut paper discharge guide. 9. Accordingly, a paper jam is not caused even if full-cut papers 21 having a high degree of curl are stored in the discharge port 10.

According to experiments conducted by the inventors, in which a roll paper having a thickness of 75 μm and a roll diameter of 80 mm was mounted on a printer having no ribs 15*a* or 15*b*, a paper jam was caused by curl of a full-cut paper 21 when the roll diameter of the roll paper became about 35 mm.

In a printer according to the present invention, in which spaces between ribs 15*a* and 15*b* were maintained at about 0.4 mm, no paper jam was caused even if the roll diameter of the roll paper was reduced to about 16 mm to about 8 mm.

The spaces between the ribs 15*a* and the ribs 15*b* depend on the roll diameter of the roll paper when the printer begins to hold full-cut papers between the ribs 15*a* and 15*b*. In the above example, when the roll diameter of the roll paper became about 40 mm, the printer began to hold full-cut papers.

In the above embodiment, the present invention is applied to a printer used for a POS terminal device. However, the present invention is not limited to this example. For example, the present invention is applicable to a printer used for an automatic dispenser and the like. Further, the number of ribs provided on the upper cover and the cut paper discharge guide is not limited to the illustrated example. The space between the upper cover and the cut paper discharge guide is mechanically varied in the above embodiment. However, the space between the upper cover and the cut paper discharge guide may electrically be varied according to the roll diameter of the roll paper, for example, by using known elements such as solenoids.

Although certain preferred embodiments of the present invention have been shown and described in detail, it should be understood that various changes and modifications may be made therein without departing from the scope of the appended claims.

What is claimed is:

1. A printer comprising a cutter unit to cut a roll paper and discharging a cut paper cut by said cutter unit through a cut paper discharging mechanism, wherein said cut paper discharge mechanism has a discharge port which has two opposing sides and is inclined at a predetermined angle with respect to a paper passage extending in a vertical direction, and wherein each of the two opposing sides of said discharge port is provided with a holding member that holds said cut paper in said discharge port such that the cut paper does not fall in said paper passage, each of said holding members including a plurality of ribs provided along said discharge port in a direction crossing a discharge direction in which the cut paper is discharged, said plurality of ribs being provided at predetermined intervals and in an alternate pattern on said holding members along the two opposing sides of said discharge port so as to hold said cut paper with both faces thereof, said plurality of ribs storing a plurality of cut papers in a portion of the discharge port.

2. The printer as recited in claim 1, wherein said cut paper discharge mechanism comprises a cutter cover installed above a stationary blade unit to define a cut paper discharge guide and an upper cover installed above a movable blade unit, said discharge port being defined between said upper cover and said cut paper discharge guide.

3. The printer as recited in claim 2, wherein said plurality of ribs are provided on said cut paper discharge guide and said upper cover.

4. The printer as recited in claim 3, wherein said plurality of ribs are arranged symmetrically with respect to a center of the direction crossing the discharge direction.

5. The printer as recited in claim 2, wherein said cutter cover is provided with a coil spring attached to said cut paper discharge guide so as to form a predetermined space between said cut paper discharge guide and said upper cover.

6. A cut paper discharge mechanism that is used in a cutter unit that cuts a roll paper, said cut paper discharge mechanism comprising:

an upper cover installed above a movable blade unit; and a cutter cover installed above a stationary blade unit to define a cut paper discharge guide;

said cut paper discharge mechanism having a discharge port which has two opposing sides and is defined between said upper cover and said cut paper discharge guide and which is inclined at a predetermined angle with respect to a paper passage extending in a vertical direction, each of the two opposing sides of said discharge port being provided with a holding member that holds said cut paper in said discharge port such that the cut paper does not fall in said paper passage, each of said holding members including a plurality of ribs provided along said discharge port in a direction crossing a discharge direction in which the cut paper is discharged, said plurality of ribs being provided at predetermined intervals and in an alternate pattern on said holding members along the two opposing sides of said discharge port so as to hold said cut paper with both faces thereof, said plurality of ribs storing a plurality of cut papers in a portion of the discharge port.

7. The cut paper discharge mechanism as recited in claim 6, wherein said plurality of ribs are provided on said cut paper discharge guide and said upper cover.

8. The cut paper discharge mechanism as recited in claim 7, wherein said plurality of ribs are arranged symmetrically with respect to a center of the direction crossing the discharge direction.

9. The cut paper discharge mechanism as recited in claim 6, wherein said cutter cover is provided with a coil spring attached to said cut paper discharge guide so as to form a predetermined space between said cut paper discharge guide and said upper cover.

10. A paper jam prevention method used in a printer having a cutter unit operable to cut a roll paper for printing, and a cut paper discharge mechanism operable to discharge a cut paper cut by the cutter unit through a discharge port having two opposing sides to an upper portion of the cut paper discharge mechanism, said cutter unit comprising a stationary blade unit and a movable blade unit, said paper jam prevention method comprising:

discharging the cut paper in a state such that the cut paper is held by said stationary blade unit when the cut paper has a low degree of curl; while discharging the cut paper in a state such that the cut paper is held in said discharge port from both faces thereof by a first plurality of ribs provided on the cut paper discharge mechanism along a first side of the two opposing sides of the discharge port and a second plurality of ribs provided on the cut paper discharge mechanism along a second side of the two opposing sides of the discharge port when the cut paper has a high degree of curl, said first and second plurality of ribs being provided at predetermined intervals in a direction crossing a discharge direction in which the cut paper is discharged and in an alternate pattern along the two opposing sides of said discharge port so as to hold said cut paper with both faces thereof, said plurality of ribs storing a plurality of cut papers in a portion of the discharge port.

* * * * *

UNITED STATES PATENT AND TRADEMARK OFFICE

CERTIFICATE OF CORRECTION

PATENT NO. : 8,882,376 B2
APPLICATION NO. : 11/519765
DATED : November 11, 2014
INVENTOR(S) : Yukio Yoshioka It is certified that error appears in the above-identified patent and that said Letters Patent is hereby corrected as shown below:

In the specification

Column 2, Line 3: delete “paper in width” and insert -- paper in a width --

Column 4, Line 6: delete “unit 6” and insert -- unit 5 --

Column 5, Line 25: delete “15aand” and insert -- 15a and --

Signed and Sealed this
Thirteenth Day of October, 2015

Michelle K. Lee

Michelle K. Lee
*Director of the United States Patent and Trademark Office*